US009657618B1

(12) United States Patent
Patel et al.

(10) Patent No.: US 9,657,618 B1
(45) Date of Patent: May 23, 2017

(54) AFTERTREATMENT SYSTEM FOR ENGINE

(71) Applicant: Electro-Motive Diesel, Inc., LaGrange, IL (US)

(72) Inventors: Ajay Patel, Joliet, IL (US); Richard C. Kulaga, Naperville, IL (US); Haridasa Raghavendra Tantry, Bangalore (IN)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/930,820

(22) Filed: Nov. 3, 2015

(51) Int. Cl.
*F01N 3/10* (2006.01)

(52) U.S. Cl.
CPC ..... *F01N 3/10* (2013.01)

(58) Field of Classification Search
USPC ..... 60/274, 296, 299, 300, 301, 302
See application file for complete search history.

(56) References Cited

U.S. PATENT DOCUMENTS 5,562,509 A 10/1996 Nakase et al.
7,430,855 B2 * 10/2008 Amemiya ..... F01N 1/084 60/286
7,713,493 B2 * 5/2010 Bosanec, Jr. ..... F01N 1/083 422/180
8,196,394 B2 * 6/2012 Fujita ..... F01N 3/035 60/286
8,540,793 B2 * 9/2013 Kasaoka ..... F01N 13/1844 422/169
8,596,049 B2 12/2013 Isada et al.
8,683,788 B2 * 4/2014 Mitsuda ..... F01N 3/0211 60/311
8,769,941 B2 7/2014 Svihla et al.
8,814,969 B2 * 8/2014 Nagasaka ..... B01D 46/0043 422/169
8,845,371 B2 9/2014 Morota et al.
2014/0248810 A1 9/2014 Ozawa

FOREIGN PATENT DOCUMENTS

EP 2687696 1/2014

* cited by examiner

*Primary Examiner* — Binh Q Tran
(74) *Attorney, Agent, or Firm* — Fahlberg Law

(57) ABSTRACT

An aftertreatment system for an engine is provided. The aftertreatment system includes a housing member having a bottom end and a top end. The housing member includes an inlet chamber and an outlet chamber defined adjacent to the bottom end and the top end, respectively. The inlet chamber is configured to receive exhaust gas via an inlet port which is coupled to an exhaust conduit of the engine to receive exhaust gas. The outlet chamber is configured to discharge the exhaust gas via an outlet port which is coupled to an exhaust pipe to discharge exhaust gas. The housing member also includes a catalytic chamber disposed between the inlet chamber and the outlet chamber. The aftertreatment system includes one or more catalyst carrying members disposed within the catalytic chamber. The one or more catalyst carrying members are configured to communicate with the inlet chamber to receive exhaust gas therethrough.

18 Claims, 3 Drawing Sheets

AFTERTREATMENT SYSTEM FOR ENGINE

TECHNICAL FIELD

The present disclosure relates to an engine and, in particular, to an aftertreatment system for the engine.

BACKGROUND

Marine vessels, such as boats and ships, include an engine for propelling the marine vessel over a water body, such as a sea or a lake. The engine is disposed within an engine room of the marine vessel. The engine includes various accessory systems, such as a fuel system, a cooling system, and a turbocharger system. The engine also includes an aftertreatment system that is in communication with exhaust gas produced by the engine. The aftertreatment system and various accessory systems are disposed adjacent to the engine. The aftertreatment system includes various exhaust treatment devices, such as particulate filters and oxidation catalysts, and Selective Catalytic Reduction (SCR) catalyst, which are used to remove undesirable emissions from the exhaust gas. In the case of a medium speed engine, a space available in the engine room may not be sufficient to accommodate such exhaust treatment device. Typically, the after treatment systems are made bulky due to capability of catalyst used for treating the exhaust gas or due to higher back pressure during operation of the engine. Since a region surrounding and above the engine are confined, the space in the engine room may not be sufficient to accommodate additional exhaust treatment devices to control emission of the engine.

U.S. Pat. No. 8,769,941 discloses a support system for an exhaust aftertreatment system for a two-stroke locomotive diesel engine. The support system provides a secure mounting of certain components of the exhaust aftertreatment system to the locomotive structure while at the same time allowing for differential thermal expansion (and the resulting physical displacement) of the components. The support system further carries the physical mass of the components of the aftertreatment system while at the same time effectively isolating the aftertreatment system from external loads and forces caused by motions of the locomotive engine and the locomotive frame.

SUMMARY OF THE DISCLOSURE

In one aspect of the present disclosure, an aftertreatment system for an engine is provided. The aftertreatment system includes a housing member having a bottom end and a top end. The housing member includes an inlet chamber defined adjacent to the bottom end. The inlet chamber is configured to receive exhaust gas via an inlet port. The inlet port is coupled to an exhaust conduit of the engine to receive exhaust gas. The housing member includes an outlet chamber defined adjacent to the top end. The outlet chamber is configured to discharge the exhaust gas via an outlet port. The outlet port is coupled to an exhaust pipe to discharge the exhaust gas. The housing member also includes a catalytic chamber disposed between the inlet chamber and the outlet chamber. The aftertreatment system further includes one or more catalyst carrying members disposed within the catalytic chamber. The one or more catalyst carrying members are configured to communicate with the inlet chamber to receive the exhaust gas therethrough.

In another aspect of the present disclosure, an engine for a marine vessel is provided. The engine includes an exhaust conduit. The aftertreatment system includes a housing member having a bottom end and a top end. The housing member includes an inlet chamber defined adjacent to the bottom end. The inlet chamber is configured to receive exhaust gas via an inlet port. The inlet port is coupled to an exhaust conduit of the engine to receive exhaust gas. The housing member includes an outlet chamber defined adjacent to the top end. The outlet chamber is configured to discharge the exhaust gas via an outlet port. The outlet port is coupled to an exhaust pipe to discharge the exhaust gas. The housing member also includes a catalytic chamber disposed between the inlet chamber and the outlet chamber. The aftertreatment system further includes one or more catalyst carrying members disposed within the catalytic chamber. The one or more catalyst carrying members are configured to communicate with the inlet chamber to receive the exhaust gas therethrough.

In yet another aspect of the present disclosure, an aftertreatment system for an engine is provided. The aftertreatment system includes a housing member having a bottom end and a top end. The housing member includes an inlet chamber defined adjacent to the bottom end. The inlet chamber is configured to receive exhaust gas via an inlet port. The inlet port is coupled to an exhaust conduit of the engine to receive exhaust gas. The housing member includes an outlet chamber defined adjacent to the top end. The outlet chamber is configured to discharge the exhaust gas via an outlet port. The outlet port is coupled to an exhaust pipe to discharge the exhaust gas. The housing member also includes a catalytic chamber disposed between the inlet chamber and the outlet chamber. The catalytic chamber includes a first compartment disposed adjacent to the inlet chamber. The catalytic chamber includes a second compartment disposed above the first compartment. The second compartment is configured to fluidly communicate with the first compartment to receive the exhaust gas. The aftertreatment further includes one or more catalyst carrying members disposed within the first compartment and the second compartment. The one or more catalyst carrying members are configured to communicate with the inlet chamber to receive the exhaust gas therethrough. Further, the housing member includes an opening configured to receive the one or more catalyst carrying members within the first compartment and the second compartment therethrough.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
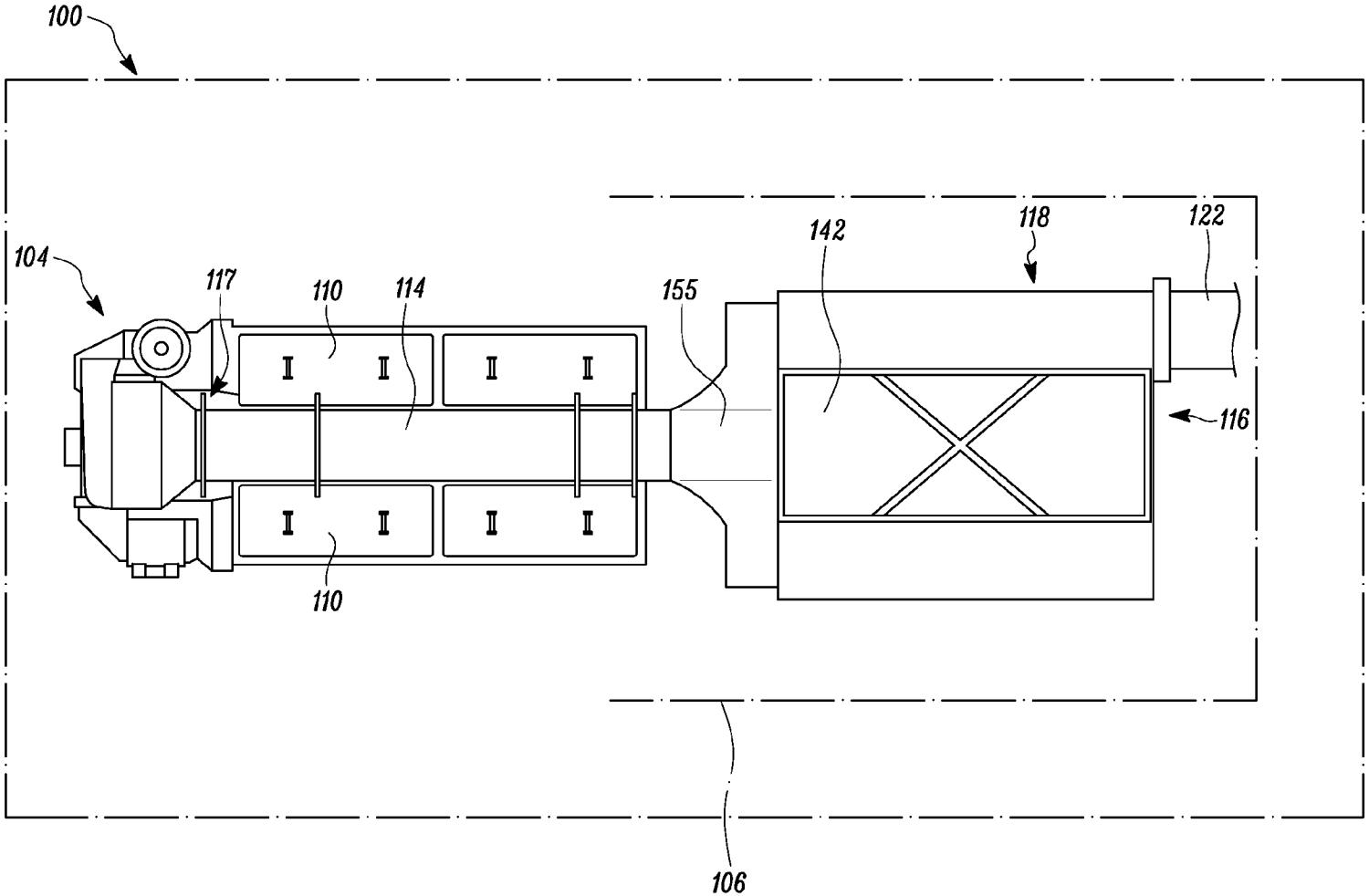
FIG. 1 is a schematic top view of an engine room in a marine vessel, according to an embodiment of the present disclosure.
Figure 2:
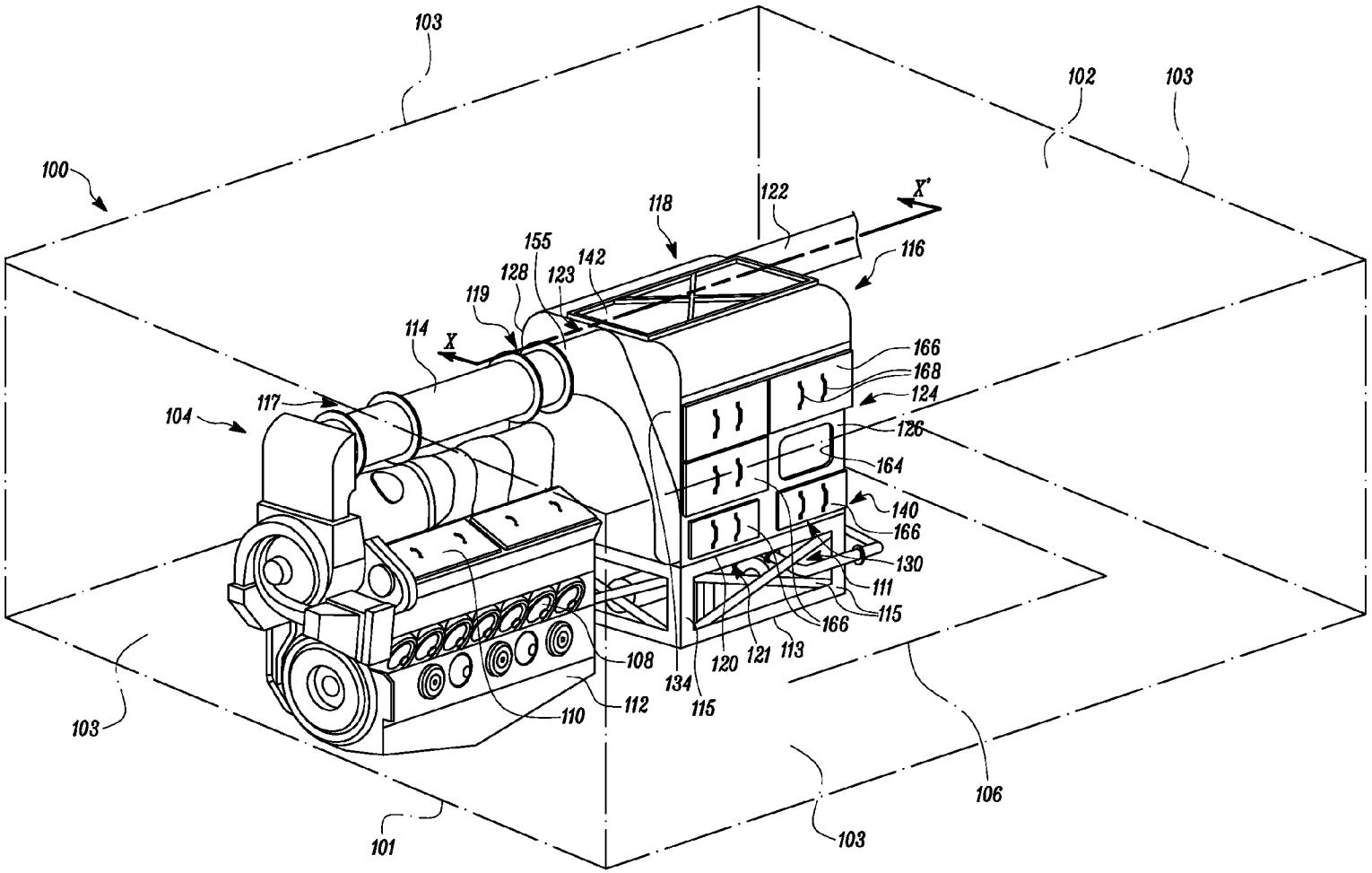
FIG. 2 is a perspective view of an engine having an aftertreatment system coupled to the engine, according to an embodiment of the present disclosure.

FIG. 1 illustrates a schematic top view of an engine room 100 disposed within a marine vessel (not shown). The marine vessel such as, for example, a ship or a boat, may be configured to be operated in a water body such as, a sea, a lake, a canal, and the like. In an embodiment, the engine room 100 may correspond to a hull portion disposed below a deck portion (not shown) of the marine vessel. However, in other embodiments, the engine room 100 may be disposed adjacent to a stern portion (not shown) of the marine vessel. The engine room 100 includes a floor 101 (shown in FIG. 2) and a ceiling wall 102 spaced apart from the floor 101. The ceiling wall 102 may be defined by the deck portion of the marine vessel. The engine room 100 also includes a plurality of side walls 103 (shown in FIG. 2) extending between the floor 101 and the ceiling wall 102. In the illustrated embodiment, an engine 104 is disposed in the engine room 100 of the marine vessel to propel the marine vessel over the water body. FIG. 2 illustrates a perspective view of the engine 104 disposed within the engine room 100. The engine 104 may be configured to provide a rotary power to a propeller (not shown) disposed below the hull portion to propel the marine vessel over the water body. The engine 104 may be an internal combustion engine run by fuels such as, diesel, gasoline, gaseous fuel, or a combination thereof. The engine 104 may further include multiple cylinders defined in various configurations such as, 'V' type configuration, in-line configuration, radial configuration or rotary configuration. In various embodiments, the engine 104 may be used to power any machine, such as on-highway vehicles, off-highway machines, earth moving equipment, or generators. Further, the engine 104 may be used in any engine powered applications such as, a locomotive, a generator, and the like.

The engine 104 includes a cylinder block 108 for defining the cylinders (not shown) therein. The engine 104 further includes a cylinder head 110 mounted on the cylinder block 108. The cylinder head 110 may define one or more intake ports for receiving ambient air and one or more exhaust ports for discharging exhaust gas from the cylinders. An intake manifold (not shown) may be coupled to the one or more intake ports for receiving the ambient air therethrough and an exhaust manifold (not shown) may be coupled to the one or more exhaust ports for discharging the exhaust gas therethrough. The engine 104 further includes an oil pan 112 for containing lubrication oil within the engine 104. The engine 104 may also include an accessory system 111 such as, a fuel supply system, an air intake system, a cooling system, and a turbocharger disposed in association with the engine 104. Referring to FIGS. 1 and 2, the engine 104 and the accessory system 111 are disposed within the engine room 100 such that a passage 106 is defined therearound. The passage 106 may allow an operator to access the engine 104 and one or more components of the accessory systems 111. The engine 104 and the accessory systems 111 may be disposed within a space available in the engine room 100 below the ceiling wall 102. The engine 104 further includes an aftertreatment system 116 configured to control emission of the exhaust gas produced by the engine 104. The aftertreatment system 116 is disposed beside the engine 104 to optimally utilize the space available in the engine room 100 below the deck portion by redistributing the one or more components of the accessory system 111 within the supporting member 113.

As shown in FIG. 2, a supporting member 113 for accommodating the one or more components of the accessory system 111 is disposed beside the engine 104. In one example, the one or more components of the accessory system 111 may be associated with cooling of various fluids of the engine 104, such as oil, fuel and coolant and may include a heat transfer unit, a filter, a pump, and hoses and/or pipes for fluidly coupling each of the one or more components.

The supporting member 113 further includes a plurality of connecting members 115 coupled together to define a space therein to accommodate the one or more components of the accessory system 111. Each of the plurality of connecting members 115 may be an elongated body, such as a bracket, coupled to one another through fastening members, such as bolts and nuts. It may be contemplated that each of the plurality of connecting members 115 may be coupled to each other via known fastening members, such as rivets and screws. The space defined by the plurality of connecting members 115 may be further configured for disposing the one or more components associated with the accessory system 111.

Referring to FIG. 2, an exhaust conduit 114 is disposed in communication with the exhaust manifold. The exhaust conduit 114 is configured to receive the exhaust gas exiting the exhaust manifold of the engine 104. In the illustrated embodiment, the exhaust conduit 114 is disposed between the cylinder head 110 and the deck portion of the marine vessel. In various embodiments, the exhaust conduit 114 may be disposed at any location in the engine room 100 below the deck portion. The exhaust conduit 114 further includes a first end 117 disposed proximal to the cylinder head 110 of the engine 104, and a second end 119 disposed distal to the cylinder head 110 of the engine 104. The first end 117 is configured to be coupled to the exhaust manifold of the engine 104 for transfer of the exhaust gas therethrough. The Exhaust gas contains emission compounds that may include oxides of Nitrogen (NOx), unburned hydrocarbons, particulate matter, and/or other combustion products known in the art.

An exhaust gas flow "F" (shown in FIG. 3) exiting the engine 104 contains emission compounds that may include oxides of nitrogen (NOx), unburned methane and other unburned hydrocarbons, particulate matter, and/or other combustion products known in the art. The aftertreatment system 116 is configured to trap or convert NOx, unburned methane, unburned hydrocarbons, particulate matter, combinations thereof, or other combustion products present in the exhaust gas flow "F", before exiting the marine vessel.

The aftertreatment system 116 includes a housing member 118 coupled to the exhaust conduit 114 for receiving the exhaust gas flow "F". The housing member 118 has a bottom end 121 and a top end 123 spaced apart from the bottom end 121. The housing member 118 includes a base member 120 adjacent to the bottom end 121, a plurality of side members 124 extending from the base member 120 towards the top end 123. In an embodiment, the side members 124 may be integrally formed with the base member 120. In another embodiment, the side members 124 may be separately coupled to the base member 120. The side members 124 include a first side member 126 and a second side member 128 spaced apart from the first side member 126. The first side member 126 extends from a first end 130 of the base member 120 and the second side member 128 extends from a second end (not shown) of the base member 120. The side members 124 also include a front side member 134 extending between the first side member 126 and the second side member 128. The front side member 134 is disposed at a front end 136 of the base member 120. The side members 124 further include a rear side member 138 (shown in FIG.

3) extending between the first side member 126 and the second side member 128 from a rear end 140 of the base member 120.

The housing member 118 further includes a top member 142 coupled to the side members 124 at the top end 123. In an embodiment, the top member 142 may be integrally formed with the side members 124. In another embodiment, the top member 142 may be separately coupled to the side members 124.

Figure 3:
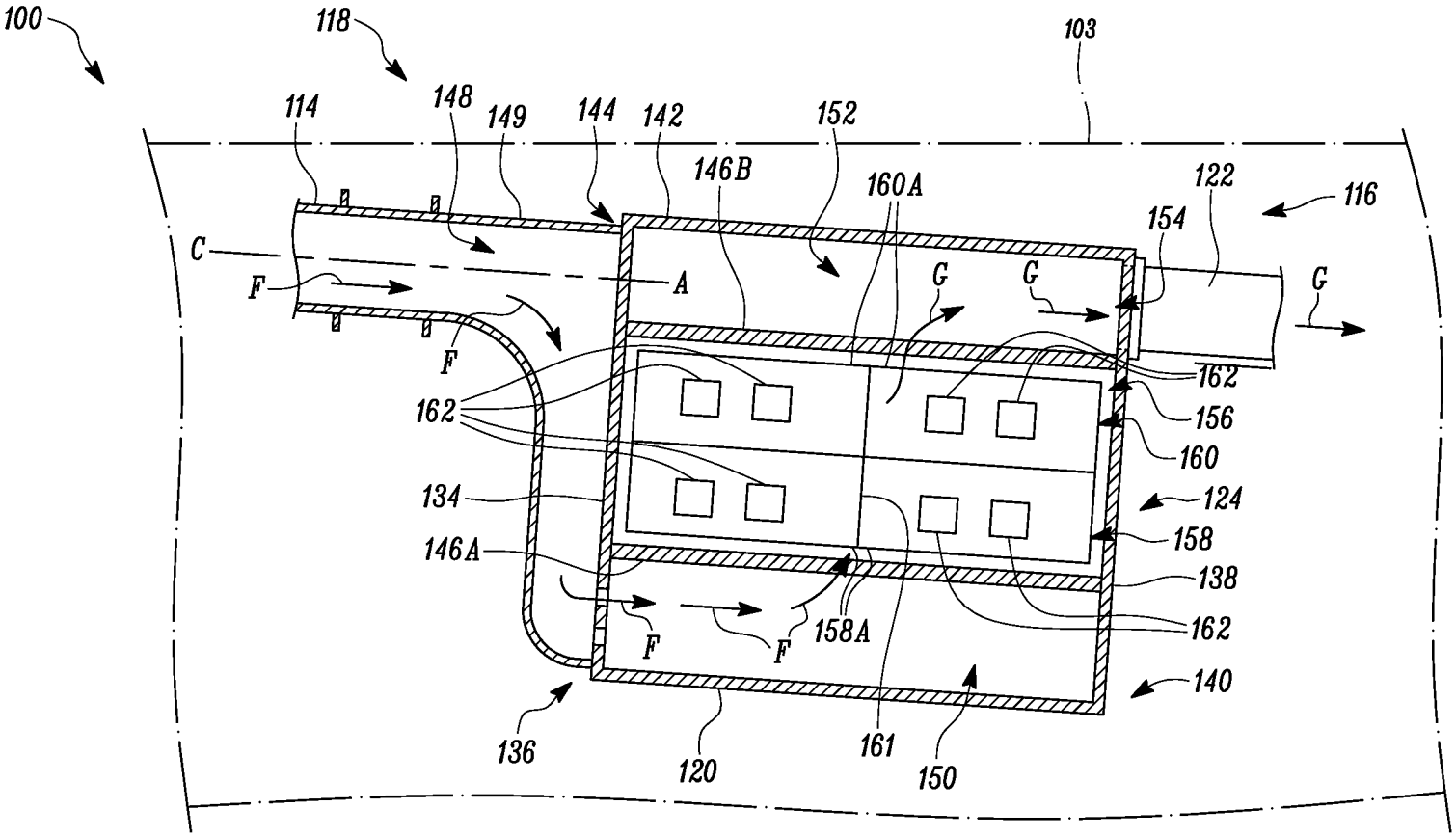
FIG. 3 is a sectional view of the aftertreatment system taken along a line X-X' in FIG. 2, according to an embodiment of the present disclosure.

FIG. 3 illustrates a sectional view of the aftertreatment system 116 taken along a line X-X' in FIG. 2. The housing member 118 includes a first connecting wall 146A disposed proximal to the base member 120, and a second connecting wall 146B disposed distal to the base member 120. Both the first connecting wall 146A and the second connecting wall 146B extend between the side members 124.

The housing member 118 further includes an inlet port 148 defined on the front side member 134, adjacent to the top member 142, along a central axis 'CA'. However, in various embodiments, the inlet port 148 may be defined on one of the second side member 128, the rear side member 138 and the first side member 126. The inlet port 148 is configured to receive the exhaust gas flow "F" from the exhaust conduit 114. The inlet port 148 may be defined by an inlet duct 149 extending from the front side member 134. In an embodiment, the inlet duct 149 may be coupled to the first side member 126 by various fastening methods such as, welding, riveting and the like. The inlet duct 149 is defined adjacent to the top member 142 and coupled to the second end 119 of the exhaust conduit 114 for receiving the exhaust gas flow "F".

The housing member 118 includes an inlet chamber 150 defined adjacent to the bottom end 121. The inlet chamber 150 is configured to receive the exhaust gas flow "F", via the inlet port 148. In the illustrated embodiment, the inlet chamber 150 is defined by the front side member 134, and the base member 120. The inlet chamber 150 further extends from the bottom end 121 to the first connecting wall 146A such that the inlet chamber 150 is in fluid communication with the inlet port 148 to receive the exhaust gas flow "F" therethrough.

The housing member 118 also includes an outlet chamber 152 defined adjacent to the top member 142, to discharge the exhaust gas to the atmosphere. In the illustrated embodiment, the outlet chamber 152 is defined by the top member 142, the second connecting member 146B, and the side members 124. The outlet chamber 152 is disposed in fluid communication with an outlet port 154. The outlet port 154 is configured to discharge an exhaust gas flow "G". The exhaust gas flow "G" may correspond to the treated exhaust gas flow "G".

In the illustrated embodiment, the outlet port 154 is defined on the rear side member 138. However, in other embodiments, the outlet port 154 may be defined at any location in the housing member 118. Further, an exhaust pipe 122 may also be in communication with the outlet port 154 to discharge the exhaust gas flow "G" to atmosphere. In an embodiment, the exhaust pipe 122 may also be coupled to a noise attenuation device such as, for example, a muffler.

The housing member 118 includes a catalytic chamber 156 disposed between the inlet chamber 150 and the outlet chamber 152. The catalytic chamber 156 is defined by the base member 120, the side members 124, and the top member 142. In particular, as illustrated, the catalytic chamber 156 is defined by the first connecting wall 146A, the second connecting wall 146B, and the side members 124. The catalytic chamber 156 is configured to be in fluid communication with the inlet chamber 150 to receive the exhaust gas flow "F". The catalytic chamber 156 includes a first compartment 158 disposed adjacent to the inlet chamber 150, and a second compartment 160 disposed above the first compartment 158. The second compartment 160 is configured to communicate with the first compartment 158 to receive the exhaust gas flow "F" and supply the exhaust gas flow "G" to the outlet chamber 152. Further, in the illustrated embodiment, each of the first compartment 158 and the second compartment 160 is divided into a pair of chambers 158A and 160A respectively, by a parting wall 161. Though each of the first compartment 158 and the second compartment 160 is shown to be divided into 2 chambers 158A, and 160A, respectively, it may be contemplated that both the first compartment 158 and the second compartment 160 may be divided into any number of chambers.

The aftertreatment system 116 includes one or more catalyst carrying members 162 disposed within the first compartment 158 and the second compartment 160 of the catalytic chamber 156. The catalyst carrying members 162 are configured to communicate with the inlet chamber 150 to receive the exhaust gas therethrough. In the illustrated embodiment, one or more of the catalyst carrying members 162 are configured to contain Selective Catalytic Reduction (SCR) catalyst. It may also be contemplated that one or more of the catalyst carrying members 162 may also be configured to contain Diesel Oxidation Catalyst (DOC) and other catalyst known in the art. The catalytic chamber 156 may be configured to support one or more exhaust treatment devices (not shown), such as a Diesel Particulate Filter (DPF) system. The DOC may be used to reduce hydrocarbons and carbon monoxide in the exhaust gas. As the exhaust gas passes through the DPF, particulate matter contained in the exhaust gas may be trapped in the DPF and prevented from releasing to the atmosphere. The catalytic chamber 156 may also include Diesel Exhaust Fluid (DEF). The DEF may be sprayed in the exhaust gas to react with the SCR catalyst, and to convert the Nitrogen Oxide into Nitrogen and water vapor. It should be noted that the catalyst carrying members 162 may also include additional components other than those listed herein to treat the exhaust gases.

In the illustrated embodiment, the aftertreatment system 116 includes two catalyst carrying members 162 in each of the chambers 158A, 160A of the first compartment 158 and the second compartment 160, respectively. In an embodiment, the catalyst carrying members 162 may be stacked together in each of the first compartment 158 and the second compartment 160. However, it may be contemplated that the catalyst carrying members 162 may be arranged in any pattern within the first compartment 158 and the second compartment 160.

Therefore, the exhaust gas being treated by the exhaust treatment devices disposed within the first compartment 158 and the second compartment 160 exits the catalytic chamber 156 to the outlet chamber 152. Thereby, the exhaust gas flow "G" exits the housing member 118, via the outlet port 154.

Referring to FIGS. 2 and 3, the housing member 118 further includes a plurality of openings 164 (only one shown in FIG. 2) defined on at least one of the first side member 126 and the second side member 128 adjacent to the catalytic chamber 156 (shown in FIG. 3). The openings 164 are configured to receive the catalyst carrying members 162 therethrough. In the illustrated embodiment, the openings 164 are defined in the first side member 126 to receive the catalyst carrying members 162 therethrough, to dispose the catalyst carrying members 162 within the catalytic chamber 156. However, it may be understood that the openings 164 may be defined at any location in the housing member 118. The catalyst carrying members 162 may be accessed through the openings 164. Further, the openings 164 may be used for servicing and maintenance of the exhaust treatment devices. The housing member 118 further includes a number of door members 166, disposed within the each of the openings 164, for closing the openings 164. Further, a pair of handles 168 may be provided on each of the door members 166 such that an operator may hold the door members 166 to access the exhaust treatment devices through the openings 164.

INDUSTRIAL APPLICABILITY

The present disclosure relates to the aftertreatment system 116 associated with the engine 104. The aftertreatment system 116 includes the housing member 118 for accommodating various exhaust treatment devices. The housing member 118 is coupled to the engine 104 via the exhaust conduit 114 to communicate with the exhaust gas produced by the engine 104. The inlet chamber 150 receives the exhaust gas flow "F" via the exhaust conduit 114. Subsequently, the exhaust gas flow "F" moves upwards from the inlet chamber 150 towards the catalytic chamber 156 to allow emission compounds to be trapped and/or converted by the exhaust treatment devices disposed within the catalytic chamber 156. Various types of exhaust treatment devices may be disposed in each of the first compartment 158 and the second compartment 160 based on various applications. Therefore, by integrating the aftertreatment system 116 with the engine 104, the space available in the engine room 100 may be optimally utilized to dispose the exhaust treatment devices. Moreover, additional exhaust treatment devices may also be disposed within the catalytic chamber 156 based on requirements. Similarly, in case of medium speed engine, the aftertreatment system 116 may be implemented to accommodate the aftertreatment devices in the engine room 100. Thus, the engine 104 along with the aftertreatment system 116 may be compactly arranged within the engine room 100 for any application.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An aftertreatment system for an engine, the engine including an engine front end, an engine rear end, an engine top, an engine bottom fixedly mounted to the floor of a room, and an engine exhaust manifold, comprising:

an exhaust conduit fluidly connected to the engine exhaust manifold at the engine front end, and extending over the engine top and past the engine rear end;

a supporting member fixedly mounted to the floor adjacent to, and spaced from, the engine rear end;

a housing member mounted on the supporting member, and having a bottom end and a top end, the housing member comprising:

an inlet chamber defined adjacent to the bottom end, the inlet chamber configured to receive exhaust gas via an inlet port, the inlet port coupled to an exhaust conduit of the engine to receive exhaust gas;

an outlet chamber defined adjacent to the top end, the outlet chamber configured to discharge the exhaust gas via an outlet port, the outlet port coupled to an exhaust pipe to discharge the exhaust gas; and a catalytic chamber disposed between the inlet chamber and the outlet chamber;

an inlet duct fluidly connecting the exhaust conduit and the inlet port; and one or more catalyst carrying members disposed within the catalytic chamber, the one or more catalyst carrying members configured to communicate with the inlet chamber to receive the exhaust gas therethrough.

2. The aftertreatment system of claim 1, wherein the housing member comprises:

a base member adjacent to the bottom end;

a plurality of side members extending from the base member; and a top member coupled to the plurality of side members adjacent to the top end, wherein the base member, the plurality of side members and the top member are together configured to define the inlet chamber, the outlet chamber and the catalytic chamber.

3. The aftertreatment system of claim 2, wherein the plurality of side members of the housing member comprises:

a first side member;

a second side member spaced apart from the first side member;

a front side member extending between the first side member and the second side member at a front end of the base member; and a rear side member extending between the first side member and the second side member at a rear end of the base member.

4. The aftertreatment system of claim 3, wherein the inlet port is defined on the front side member adjacent to the top end of the housing member along a central axis, and wherein the inlet chamber is defined adjacent to the front side member and extends from the top end to the bottom end of the housing member.

5. The aftertreatment system of claim 3, wherein the housing member comprises an opening defined on at least one of the first side member and the second side member adjacent to the catalytic chamber, and wherein the opening is configured to receive the one or more catalyst carrying members therethrough.

6. The aftertreatment system of claim 1, further comprising a door member disposed within the opening.

7. The aftertreatment system of claim 1, wherein the catalytic chamber comprises:

a first compartment disposed adjacent to the inlet chamber; and a second compartment disposed above the first compartment, the second compartment configured to communicate with the first compartment to receive the exhaust gas.

8. An engine for a marine vessel with an engine room, the engine including an engine front end, an engine rear end, an engine top, an engine bottom fixedly mounted to the floor of the engine room, and an engine exhaust manifold comprising:

an exhaust conduit fluidly connected to the engine exhaust manifold at the engine front end, and extending over the engine top and past the engine rear end; and an aftertreatment system coupled to the exhaust conduit, the aftertreatment system comprising:

a supporting member fixedly mounted to the floor adjacent to, and spaced from, the engine rear end;

a housing member mounted on the supporting member, and having a bottom end and a top end, the housing member comprising:

an inlet chamber defined adjacent to the bottom end, the inlet chamber configured to receive exhaust gas via an inlet port, the inlet port coupled to an exhaust conduit of the engine to receive exhaust gas;

an outlet chamber defined adjacent to the top end, the outlet chamber configured to discharge the exhaust gas via an outlet port, the outlet port coupled to an exhaust pipe to discharge the exhaust gas; and a catalytic chamber disposed between the inlet chamber and the outlet chamber;

an inlet duct fluidly connecting the exhaust conduit and the inlet port; and one or more catalyst carrying members disposed within the catalytic chamber, the one or more catalyst carrying members configured to communicate with the inlet chamber to receive the exhaust gas therethrough.

9. The engine of claim 8, wherein the housing member comprises:

a base member adjacent to the bottom end;

a plurality of side members extending from the base member; and a top member coupled to the plurality of side members adjacent to the top end, wherein the base member, the plurality of side members and the top member are together configured to define the inlet chamber, the outlet chamber and the catalytic chamber.

10. The engine of claim 9, wherein the plurality of side members of the housing member comprises:

a first side member;

a second side member spaced apart from the first side member;

a front side member extending between the first side member and the second side member at a front end of the base member; and a rear side member extending between the first side member and the second side member at a rear end of the base member.

11. The engine of claim 10, wherein the inlet port is defined on the front side member adjacent to the top end of the housing member along a central axis, and wherein the inlet chamber is defined adjacent to the front side member and extends from the top end to the bottom end of the housing member.

12. The engine of claim 10, wherein the housing member comprises an opening defined on at least one of the first side member and the second side member adjacent to the catalytic chamber, and wherein the opening is configured to receive the one or more catalyst carrying members therethrough.

13. The engine of claim 12, wherein the housing member comprises a door member disposed within opening.

14. The engine of claim 10, wherein the catalytic chamber comprises:

a first compartment disposed adjacent to the inlet chamber; and a second compartment disposed above the first compartment, the second compartment configured to fluidly communicate with the first compartment to receive the exhaust gas.

15. An aftertreatment system for an engine, the engine including an engine front end, an engine rear end, an engine top, an engine bottom fixedly mounted to the floor of a room, and an engine exhaust manifold, comprising:

an exhaust conduit fluidly connected to the engine exhaust manifold at the engine front end, and extending over the engine top and past the engine rear end;

a supporting member fixedly mounted to the floor adjacent to, and spaced from, the engine rear end;

a housing member mounted on the supporting member, and having a bottom end and a top end, the housing member comprising:

an inlet chamber defined adjacent to the bottom end, the inlet chamber configured to receive exhaust gas via an inlet port, the inlet port coupled to an exhaust conduit of the engine to receive exhaust gas;

an outlet chamber defined adjacent to the top end, the outlet chamber configured to discharge the exhaust gas via an outlet port, the outlet port coupled to an exhaust pipe to discharge the exhaust gas; and a catalytic chamber disposed between the inlet chamber and the outlet chamber, the catalytic chamber comprising:

a first compartment disposed adjacent to the inlet chamber; and a second compartment disposed above the first compartment, the second compartment configured to fluidly communicate with the first compartment to receive the exhaust gas;

an inlet duct fluidly connecting the exhaust conduit and the inlet port; and one or more catalyst carrying members disposed within the first compartment and the second compartment, the one or more catalyst carrying members configured to communicate with the inlet chamber to receive the exhaust gas therethrough; and wherein the housing member comprises an opening configured to receive the one or more catalyst carrying members within the first compartment and the second compartment therethrough.

16. The aftertreatment system of claim 15, wherein the housing member comprises:

a base member adjacent to the bottom end;

a plurality of side members extending from the base member; and a top member coupled to the plurality of side members adjacent to the top end, wherein the base member, the plurality of side members and the top member are together configured to define the inlet chamber, the outlet chamber and the catalytic chamber.

17. The aftertreatment system of claim 16, wherein the plurality of side members of the housing member comprises:

a first side member;

a second side member spaced apart from the first side member;

a front side member extending between the first side member and the second side member at a front end of the base member; and a rear side member extending between the first side member and the second side member at a rear end of the base member.

18. The aftertreatment system of claim 17, wherein the inlet port is defined on the front side member adjacent to the top end of the housing member along a central axis, and wherein the inlet chamber is defined adjacent to the front side member and extends from the top end to the bottom end of the housing member.

* * * * *